United States Patent [19]

Haskins et al.

[11] Patent Number: 4,867,036

[45] Date of Patent: Sep. 19, 1989

[54] ELECTROMAGNETIC GUN BORE RIDER

[75] Inventors: Harold J. Haskins, Irvine; Arnold J. Laderman, Laguna Beach, both of Calif.

[73] Assignee: Ford Aerospace & Communications Corporation, Newport Beach, Calif.

[21] Appl. No.: 127,727

[22] Filed: Dec. 2, 1987

[51] Int. Cl.[4] ..... F42F 1/02; F42B 13/16

[52] U.S. Cl. ..... 89/8; 102/520; 124/3

[58] Field of Search ..... 89/8; 102/520, 521, 102/522, 523, 524, 525, 526, 527, 528; 124/3

[56] References Cited

U.S. PATENT DOCUMENTS

| | | | |
|---|---|---|---|
| Re. 1,098 | 12/1860 | James | 102/525 |
| 34,493 | 2/1862 | Havens | 102/525 |
| 112,121 | 2/1871 | Butler | 102/525 |
| 2,998,779 | 9/1961 | MacRoberts | 102/523 |
| 3,023,704 | 3/1962 | Dawson et al. | 102/524 |
| 3,613,596 | 10/1971 | Walde | 102/525 |
| 4,239,006 | 12/1980 | Kelson | 102/522 |
| 4,343,223 | 8/1982 | Hawke et al. | 89/8 |
| 4,608,908 | 9/1986 | Carlson et al. | 89/8 |
| 4,638,739 | 1/1987 | Sayles | 102/520 |

FOREIGN PATENT DOCUMENTS

| | | | |
|---|---|---|---|
| 3114080 | 11/1982 | Fed. Rep. of Germany | 102/525 |

*Primary Examiner*—Stephen C. Bentley
*Attorney, Agent, or Firm*—Harry G. Weissenberger; Edward J. Radlo; Keith L. Zerschling

[57] ABSTRACT

An electromagnetic gun assembly includes a gun barrel, a projectile structure disposed within the gun barrel, and a plurality of bore rider members disposed between the projectile structure and the gun barrel. The bore rider members are dimensioned and arranged to maintain the projectile structure spaced-apart from the gun barrel, restrict lateral movement of the projectile structure relative to the gun barrel, accommodate ablative mass loss, and accommodate static and dynamic gun barrel expansion. Each bore rider member has a tapered shape that includes converging first and second surfaces, the first surface facing the gun barrel, the second surface facing the projectile structure, and the first and second surfaces converging in a direction opposite to a direction of acceleration in which the projectile structure is to be accelerated along the gun barrel. Each bore rider member is moveably disposed in a position such that as ablative mass loss occurs to the bore rider member, it moves relative to the projectile structure in the direction in which the first and second surfaces converge to remain wedged between the projectile structure and the gun barrel.

4 Claims, 1 Drawing Sheet

ELECTROMAGNETIC GUN BORE RIDER

LICENSE RIGHTS

The U.S. Government has a paid-up license in this invention and the right in limited circumstances to require the patent owner to license others on reasonable terms as provided for by the terms of that certain contract No. F29601-85-C-0100 awarded by the U.S. Air Force Space Technology Center.

BACKGROUND OF THE INVENTION

1. Technical Field

This invention relates generally to electromagnetic rail guns, and more particularly to a new and improved launch assembly for use with such a gun.

2. Background Information

Electromagnetic guns are used to accelerate small projectiles to hypervelocity speeds. The projectile structure may include a projectile enclosed by a sabot, and this structure is configured to fit snugly in the gun barrel. Together, the projectile structure and electromagnetic gun may be called an electromagnetic gun assembly that launches the projectile. It does this with electromagnetic forces produced as electric current flows down a conductive rail on one side of the barrel, across a conductive medium (armature) at the rear of the projectile structure, and then back along a second conductive rail on the other side of the barrel.

Due to the high velocities attained, the interface between the sabot and the barrel is subject to large shear or frictional forces as the projectile structure is accelerated down the barrel. The associated frictional heating can lead to excessive ablation of the sabot so that the gap at the sabot-barrel interface increases. Also, barrel expansion from internal pressure and shot-to-shot wear can result in dynamic and static increases in the barrel size relative to the projectile structure. As these effects occur, the increased gap may result in a balloting motion of the projectile structure, i.e. an oscillating lateral motion caused by a loose fit.

This balloting motion is characterized by repetitive ricocheting of the projectile structure off opposite walls of the gun barrel that can result in structural failure of the sabot and excessive damage to the barrel. In addition, balloting can introduce angular tip-off, where lateral forces cause the projectile to exit the muzzle at an angle inclined to the barrel axis.

Consequently, it is desirable to have an electromagnetic gun assembly that maintains the projectile structure in substantially constant and uniform contact with the barrel during launch in order to eliminate such spurious motion.

Prior art in this field includes U.S. Pat. No. 112,121 to Butler which relies on a flexible metallic disk that is flattened against the projectile base by the force of discharge. The motion of the disk forces attached wedges forward into beveled slots in the projectile, thereby driving out radial studs into grooves in the barrel wall. The motion of the studs in the grooves imparts rotation to the projectile. Each wedge requires a pin or key inserted into the studs which prevents the studs from being thrown from the socket after the projectile leaves the gun.

The projectile described in the Butler patent requires a metal base plate, a large number of interrelated moving parts to initiate motion of the studs, keys and pins to retain the studs after exit from the barrel, and it is intended to rotate the projectile. None of these features are required or desired with the present invention. In addition, the present invention is not restricted to projectile structures of circular cross-section, and it does not require grooves (rifling) in the barrel walls.

U.S. Pat. No. 1,098 to James describes a projectile to be used in a rifled cannon for the purpose of imparting to the projectile, when fired, a rotary motion about its axis and to eliminate windage, thereby increasing the force of the discharge. It relies on the pressure in the chamber, or the motion of a tapered wedge in the projectile base to force an expansive packing surrounding the projectile into contact with the bore of the gun and into grooves thereof. This causes the projectile to be rotated as it is being discharged.

The projectile described in the James patent relies on the force of discharge acting directly on the packing or on a conical wedge to expand the packing into rifled grooves. In addition, it is restricted to projectiles of circular cross-section, and it is intended to rotate the projectile.

U.S. Pat. No. 34,493 to Havens describes a projectile requiring two cast iron pieces, and it is restricted to cylindrically-shaped projectiles of circular cross-section. The rear piece has a conical front portion which mates to the base of the front piece. When the charge is fired the rear piece of the projectile is driven toward the front piece with the conical front section causing tapered segments to expand radially against the wall of the gun. This radial motion causes the tapered segments to expand into grooves in the barrel to prevent windage.

Thus the projectile described in the Havens patent requires a two-piece projectile, it relies on relative motion between the front and rear portions of the projectile, and it depends on the force of the explosive charge.

U.S. Pat. No. 3,023,704 to Dawson, et al. describes projectiles for mortars and like projectors having unrifled barrels. Such projectiles require a comparatively large clearance between the largest circumference of the projectile structure and the barrel walls. The projectile is intended to reduce leakage of propellant gases through the clearance gap and is restricted to projectiles of circular cross-section. It relies on the pressure of the propellant gases to distort a resilient annular ring or to move it forward to seal the gap, as opposed to eliminating spurious lateral motion of the projectile.

SUMMARY OF THE INVENTION

This invention solves the problems associated with the prior art by providing an assembly with tapered pads or bore riders between the projectile structure and the gun barrel. The tapered configuration of the bore riders allows self-adjusting, rearward translational motion of the bore riders to compensate for ablation mass loss, and this maintains constant contact with the barrel that restricts lateral movement of the projectile structure.

In other words, as the bore riders wear away, they slide along matched tapered grooves in the projectile structure to move opposite the direction of acceleration into the sabot-barrel gap. Thus, they wedge into the gap to maintain the desired contact and thereby reduce spurious motion.

Generally, an electromagnetic gun assembly constructed according to the invention includes a gun barrel and a projectile structure disposed within the gun barrel. The projectile structure may take the form of a projectile encased in a sabot measuring ten to twenty centimeters across, for example.

According to a major aspect of the invention, there is provided a plurality of bore rider members disposed between the projectile structure and the gun barrel. The bore rider members are dimensioned and arranged to maintain the projectile structure spaced-apart from the gun barrel, such that friction forces between the projectile structure and the barrel are minimized. In addition, they restrict lateral movement of the projectile structure relative to the gun barrel and accommodate ablative mass loss resulting from frictional forces produced during acceleration of the projectile structure along the gun barrel.

Each one of the bore rider members has a tapered shape that includes converging first and second surfaces, the first surface facing the gun barrel, the second surface facing the projectile structure, and the first and second surfaces converging in a direction opposite to a direction of acceleration in which the projectile structure is to be accelerated along the gun barrel. Each one of the bore rider members is moveably disposed in a position such that as ablative mass loss occurs to the bore rider member, it moves relative to the projectile structure in the direction in which the first and second surfaces converge to remain wedged between the projectile structure and the gun barrel.

According to another aspect of the invention, there is provided a plurality of longitudinally-extending grooves in the projectile structure. Each one of the grooves is dimensioned and arranged to receive one of the bore rider members, and includes an inclined surface against which the bore rider members seats. The inclined surface inclines toward the gun barrel as it extends in a direction generally opposite to the direction of acceleration.

In line with the above, the invention includes a method of reducing spurious motion of a projectile structure as it is accelerated in the barrel of an electromagnetic gun. The method proceeds by maintaining the projectile structure spaced-apart from the gun barrel during acceleration with tapered bore rider members moveably disposed between the projectile structure and the gun barrel. This is done so that as ablative mass loss occurs to the bore rider members, the bore rider members move relative to the projectile structure to remain wedged between the projectile structure and the gun barrel.

DESCRIPTION OF THE PREFERRED EMBODIMENTS

Figure 1:
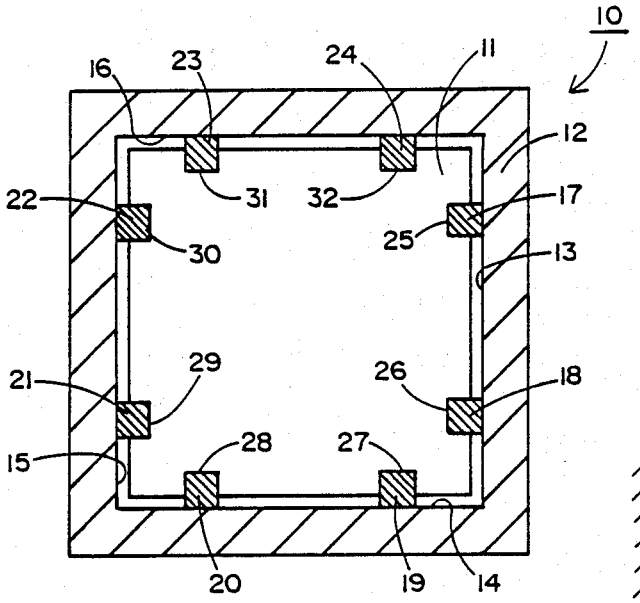
FIG. 1 of the drawings is a diagrammatic cross sectional view of an electromagnetic gun assembly constructed according to the invention that includes a projectile structure mounted on eight bore riders within a square-bore electromagnetic gun barrel.

Referring now to the drawings, there is shown a new and improved electromagnetic gun assembly 10 constructed according to the invention. The assembly 10 includes a projectile structure 11 disposed within a generally square electromagnetic gun barrel 12 where it is maintained spaced-apart from the gun barrel walls 13–16 by bore rider members or bore riders 17–24. The projectile structure 11 may take any of various forms, such as a projectile encased in a sabot. Similarly, the gun barrel 12 may be conventionally configured in any of various shapes and with electrically conductive rails and other components that are not shown but conventionally utilized to accelerate the projectile structure 11 along the gun barrel 12. The illustrated square shapes may be used, for example, in applications where aerodynamic considerations are unimportant.

The invention provides a means of maintaining a generally constant gap width at the interface between the projectile structure 11 and the gun barrel walls 13–16. The bore riders 17–24, fabricated from a material with large heat of ablation (e.g., graphite), seat in matching grooves 25–32 in the projectile structure 11 in order to constrain lateral motion of the projectile structure 11, i.e., motion generally transverse to a longitudinal axis of the gun barrel 12 (not shown) along which the projectile structure 11 is accelerated.

The bore riders 17–24 are disposed between the gun barrel walls 13–16 and the projectile structure 11. They are dimensioned and arranged to maintain the projectile structure 11 spaced-apart from the gun barrel 12. They restrict lateral movement of the projectile structure 11 relative to the gun barrel 12, and they accommodate ablative mass loss resulting from frictional forces produced during acceleration of the projectile structure 11 along the gun barrel 12.

The bore riders 17–24 are disposed between the gun barrel walls 13–16 and the projectile structure 11 so that they can move relative to the projectile structure 11 in a direction opposite a direction of acceleration in which the projectile structure 11 is to be accelerated along the longitudinal axis of the gun barrel 12. In other words, bore riders 17–24 are free to translate in the aft direction as material is ablated from them during transit along the gun barrel 12. The gap between the projectile structure 11 and the gun barrel walls 13–16 is sized to exceed the maximum gas layer thickness developed between the gun barrel walls 13–16 and the bore riders 17–24 due to the ablation process. Initially, however, the bore riders 17–24 directly contact the gun barrel walls 13–16.

Figure 2:
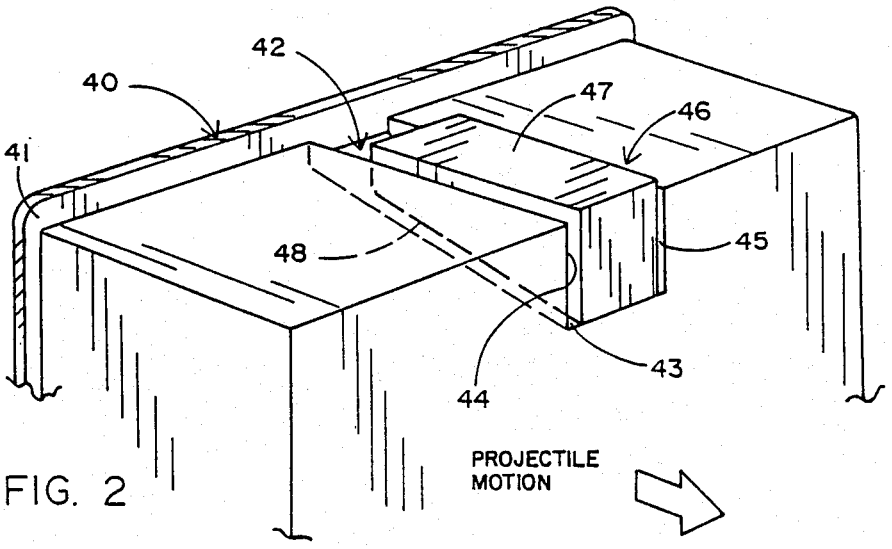
FIG. 2 is an enlarged perspective view of a portion of another projectile structure, showing a typical bore rider configuration.

Further details of operation are shown in FIG. 2, which is an enlarged perspective view of a portion of another projectile structure 40. The projectile structure 40 is illustrated apart from the gun barrel 12, although it is intended to represent a projectile structure that is dimensioned and arranged to fit loosely within the gun barrel 12 with a gap of the desired size. It includes an obturator member 41 that fits snugly within the gun barrel 12 as a base or pusher plate.

The projectile structure 40 defines a longitudinally-extending groove 42 having an inclined surface 43 and sidewalls 44 and 45. This groove 42 is dimensioned and arranged to receive a bore rider 46 having a tapered shape that includes converging first and second surfaces 47 and 48. The first surface 47 faces the gun barrel 12 (when the projectile structure is within the gun barrel), the second surface 48 faces the projectile structure 40, and the first and second surfaces 47 and 48 converge in a direction opposite to a direction of acceleration in which the projectile structure 40 is to be accelerated along the gun barrel 12. The direction of acceleration is designated in FIG. 2 by an arrow alongside the words "Projectile Motion."

The bore rider 46 seats against the surface 43 of groove 42. With the projectile structure within the gun barrel 12, the inclined surface 43 inclines toward the gun barrel 12 as it extends in a direction generally opposite to the direction of acceleration. The incline is such that the distance the bore rider 46 extends out of the groove 42 toward the gun barrel 12, and the corresponding depth of the groove 42 (the distance of the inclined surface 43 from the gun barrel 12), both diminish in the aft direction.

Thus, the groove 42 may be called a matched tapered groove, and it receives the bore rider 46 somewhat loosely so that the bore rider 46 can move in a direction opposite to the direction of acceleration. This direction is designated in FIG. 2 by an arrow alongside the words "Relative Bore Rider Motion." With the bore rider 46 within the groove 42 in this way, it is moveably disposed in a position such that as ablative mass loss occurs to the bore rider 46, it moves relative to the projectile structure 40 in the direction in which the first and second surfaces 47 and 48 converge (opposite the direction of acceleration) to remain wedged between the projectile structure 40 and the gun barrel 12.

In other words, as the first surface 47 of the bore rider 46 ablates, the bore rider 46 moves relative to the projectile structure 40. As this occurs, the groove 42 serves as retainer means for retaining the bore rider 46 in desired alignment with said projectile structure 40, confined between the sidewalls 44 and 45.

Initially, the bore rider 46 is located in the foremost position (further away from the obturator member 41), and its exposed surface (the first surface 47) is essentially in direct contact with the gun barrel 12 (touching one of the gun barrel walls 13–16). Frictional heating generated during launch of the projectile structure 40 causes ablation of the bore rider 46, however, and the mass removal from the bore rider 46 increases the gap between the bore rider 46 and the gun barrel 12. As this gap increases, the combination of acceleration forces and frictional drag causes the bore rider 46 to slide aft in the groove 42 (toward the obturator member 41).

This relative motion causes the bore rider 46 to maintain contact with the gun barrel 12 so that balloting and tip-off of the projectile structure 11 are substantially eliminated. For large frictional heating rates, the gas produced by vaporization of the bore rider 46 can lead to the development of a thin, self-pumped gas bearing at the interface between the first surface 47 of the bore rider 46 and the gun barrel 12. However, the performance and principle of operation of the bore rider 46 are independent of the frictional processes at the interface (i.e., whether the frictional forces are induced by sliding contact or by hydrodynamic shear).

Figure 3:
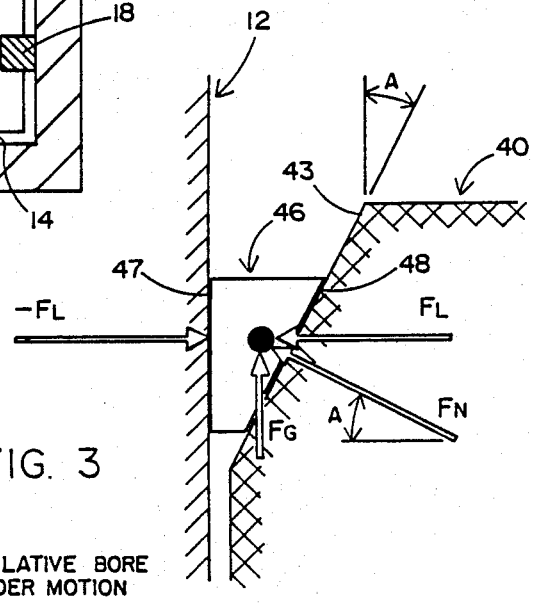
FIG. 3 is a force diagram showing the forces acting on a bore rider during launch.

Considering now FIG. 3, there is shown a force diagram that illustrates the forces during acceleration. During launch the force $F_N$, acting normal to the interface between the second surface 48 of the bore rider 46 and the inclined surface 43 of the projectile structure 40, can be expressed as:

$$F_N = M_B\, a/\sin A$$

where $M_B$ is the bore rider mass, a is the launch acceleration, and A is the angle of bore rider taper relative to the longitudinal axis of the gun barrel 12. It follows that the lateral load $F_L$ exerted at the interface of the first surface 47 of the bore rider 46 and the gun barrel 12 is given by:

$$F_L = F_N \cos A$$

$$F_L = M_B\, a/\tan A$$

and that the frictional force $F_F$ acting on the bore rider surface is:

$$F_F = f_{eff} F_L$$

$$F_F = f_{eff} M_B\, a/\tan A$$

where $f_{eff}$ is the effective coefficient of sliding friction. The total frictional heat dissipation $Q_F$, which causes ablation of the bore rider 46, can be written as:

$$Q_F = F_F L$$

$$Q_F = f_{eff} M_B\, aL/\tan A$$

where L is the length of the gun barrel 12 (or launch tube). Therefore, the mass ablated $M_A$ is given by:

$$M_A = Q_F/Q_A$$

$$M_A = f_{eff} M_B aL/Q_A \tan A$$

where $Q_A$ is the heat of ablation of the bore rider material (i.e., the heat per unit mass required to vaporize the material of which the bore rider 46 is composed). Finally, the thickness $X_A$ of material ablated during launch can be expressed as:

$$X_A = M_A/\text{density}\cdot S$$

where density is the density of the bore rider material and S is the surface area of the first surface 47 of the bore rider 46 in contact with the gun barrel 12. For graphite bore riders, best estimates of the above parameters are:

| Parameter | Value |
|---|---|
| density | 1.92 grams/cm$^3$ |
| S | 6.45 cm$^2$ |
| $M_B$ | 16 grams |
| a | $10^5$ g's |
| A | 30 degrees |
| $f_{eff}$ | 0.1 |
| L | 40 meters |
| $Q_A$ | 30 MJ/kg |

Substituting numerical values into the above equations yields a total ablation mass loss $M_A = 3.8$ grams and an ablation depth $X_A = 0.3$ centimeters. The mass loss is less than twenty-five percent of the initial bore rider mass. In this connection, it should be noted that a smaller, more typical value of coefficient of friction will yield correspondingly less ablation loss.

Thus, the invention solves the problems associated with the prior art by providing tapered pads or bore riders between the projectile structure and the gun barrel. The tapered configuration of the bore riders allows self-adjusting, rearward translational motion of the bore riders to compensate for ablation mass loss, and this maintains constant contact with the barrel that restricts lateral movement of the projectile structure. As the bore riders wear away, they slide along matched tapered grooves in the projectile structure to move opposite the direction of acceleration into the sabot-barrel gap so that they wedge into the gap to maintain the desired contact and thereby reduce spurious motion.

Although an exemplary embodiment of the invention has been shown and described, many changes, modifications, and substitutions may be made by one having ordinary skill in the art without necessarily departing from the spirit and scope of this invention. For example, a fluorinated hydrocarbon material, such as the commercially available material sold under the tradename Teflon, or other plastic material, may be employed instead of the graphite material discussed above.

What is claimed is:

1. An electromagnetic gun assembly, comprising:

(a) a gun barrel;

(b) a projectile structure disposed within said gun barrel; and (c) a plurality of bore rider members disposed between said projectile structure and said gun barrel, said bore rider members being dimensioned and arranged to maintain said projectile structure spaced-apart from said gun barrel, restrict lateral movement of said projectile structure relative to said gun barrel, accommodate ablative mass loss resulting from frictional forces produced during acceleration of said projectile structure along said gun barrel, and accommodate static and dynamic gun barrel expansion;

(d) each one of said bore rider members having a tapered shape that includes converging first and second surfaces, said first surface facing said gun barrel, said second surface facing said projectile structure, and said first and second surfaces converging in a direction opposite to a direction of acceleration in which said projectile structure is to be accelerated along said gun barrel; and (e) each of said bore rider members being moveably disposed in a position such that as ablative mass loss occurs to said one bore rider member, said bore rider member moves relative to said projectile structure in said direction in which said first and second surfaces converge to remain wedged between said projectile structure and said gun barrel;

(f) said projectile structure including retainer means for retaining said bore rider members in desired alignment with said projectile structure, said retainer means including a plurality of circumferentially spaced longitudinally-extending grooves on said projectile structure, each one of said grooves being dimensioned and arranged to receive one of said bore rider members.

2. An assembly as recited in claim 1, wherein the circumference of said projectile structure is rectangular, the total circumferential extent of said grooves is a minor portion of the circumference of said projectile structure, and each of said grooves includes an inclined surface against which a respective one of said bore rider members seats, said inclined surface inclining toward said gun barrel as said inclined surface extends in a direction generally opposite to said direction of acceleration.

3. An assembly as recited in claim 1 wherein:

said bore rider members are composed of a graphite material.

4. An assembly as recited in claim 1 wherein:

said bore rider members are composed of a plastic material.

* * * * *